US007303343B2

(12) United States Patent
Kajihara et al.

(10) Patent No.: US 7,303,343 B2
(45) Date of Patent: Dec. 4, 2007

(54) PRINTING SYSTEM, METHOD FOR PROCESSING DATA IN PRINTING SYSTEM, PROGRAM, AND STORAGE MEDIUM

(75) Inventors: Mikihiro Kajihara, Matsumoto (JP); Mamoru Sakai, Kawasaki (JP); Hiroshi Ono, Tokyo (JP)

(73) Assignees: Seiko Epson Corporation, Tokyo (JP); King Jim Co., Ltd., Tokyo (JP)

( * ) Notice: Subject to any disclaimer, the term of this patent is extended or adjusted under 35 U.S.C. 154(b) by 522 days.

(21) Appl. No.: 10/918,706

(22) Filed: Aug. 13, 2004

(65) Prior Publication Data

US 2005/0073720 A1 Apr. 7, 2005

(30) Foreign Application Priority Data

Sep. 12, 2003 (JP) ..... 2003-321761

(51) Int. Cl.
*B41J 29/38* (2006.01)

(52) U.S. Cl. ..... 400/76; 358/1.6; 358/1.18

(58) Field of Classification Search ..... None
See application file for complete search history.

(56) References Cited

U.S. PATENT DOCUMENTS 6,064,802 A * 5/2000 Watanabe et al. ..... 358/1.11
6,142,685 A * 11/2000 Watanabe et al. ..... 400/61
6,644,873 B2 * 11/2003 Kurashina ..... 400/61

FOREIGN PATENT DOCUMENTS

| | | | |
|---|---|---|---|
| JP | 07-219931 | | 8/1995 |
| JP | 07314802 | A * | 12/1995 |
| JP | 11232266 | A * | 8/1999 |
| JP | 2001030546 | A * | 2/2001 |

* cited by examiner

*Primary Examiner*—Daniel J. Colilla
(74) *Attorney, Agent, or Firm*—Hogan & Hartson LLP

(57) ABSTRACT

A printing system includes a supply device and a tape printing device. The supply device includes a widthwise-size setting unit that sets the size of a print table image in the tape-width direction based on the tape width notified by the printing device, a table structure input unit that inputs the number of rows and columns of a table, a reference table creating unit that creates reference table borders based on the set size of the print table image in the tape-width direction and the input number of rows and columns, and a print table image data editing unit that edits the print table image data by editing a plurality of reference horizontal borders and reference vertical borders of the reference table borders.

5 Claims, 14 Drawing Sheets

PRINTING SYSTEM, METHOD FOR PROCESSING DATA IN PRINTING SYSTEM, PROGRAM, AND STORAGE MEDIUM

BACKGROUND OF THE INVENTION

1. Field of the Invention

This invention relates to a printing system, a method for processing data in the printing system, a program, and a storage medium. More particularly, the printing system of this invention serves as a separate type of tape printing apparatus, including a supply device capable of supplying print table image data of table borders having a plurality of horizontal borders and a plurality of vertical borders for defining table rows and columns and a tape printing device capable of printing a print table image based on the supplied print table image data onto a tape.

2. Description of the Related Art

In such a printing system of the related art, for example, in combination with application software installed in a personal computer serving as a supply device, a tape printing device provides higher operability and more variable print image creating or editing than a tape printing device used in a stand-alone manner. The application software has a function of drawing graphics using drawing objects, such as straight lines, rectangles, arrows, and ellipses, and the drawing objects are used to create or edit table borders to form a print table image.

In this printing system, drawing objects such as straight lines and rectangles are combined to create table borders. It is therefore necessary to determine the position and size of each drawing object, and it takes a particularly long time to create table borders on a tape with narrow print width and unlimited print length, which inconveniences the user.

SUMMARY OF THE INVENTION

Accordingly, it is an advantage of this invention to provide a separate type of printing system capable of easily creating table borders to form a print table image on a tape, and to provide a method for processing data in the printing system, a program, and a storage medium.

In one aspect, this invention provides a printing system comprising a supply device that supplies print table image data of table borders having a plurality of horizontal borders and a plurality of vertical borders for defining table rows and columns, and a tape printing device that prints a print table image based on the supplied print table image data onto a tape. The supply device and the tape printing device are connected via an interface. The tape printing device includes a tape-width notifying unit that notifies the supply device of the tape width of a tape accommodated in the tape printing device. The supply device comprises a widthwise-size setting means for setting the size of the print table image in the tape-width direction based on the tape width, a table structure input means for inputting the number of rows and columns defined by the table borders, a reference-table-border creating means for creating reference table borders having a plurality of reference horizontal borders and a plurality of reference vertical borders based on the set size of the print table image in the tape-width direction and the input number of rows and columns, and print table image data editing means for editing the print table image data by changing and editing the length and position of the plurality of reference horizontal borders and the plurality of reference vertical borders.

In another aspect, this invention provides a method for processing data in a printing system including a supply device that supplies print table image data of table borders having a plurality of horizontal borders and a plurality of vertical borders for defining table rows and columns, and a tape printing device that prints a print table image based on the supplied print table image data onto a tape, wherein the supply device and the tape printing device are connected via an interface. The method comprises a tape-width notifying step of notifying the supply device of a tape width of a tape accommodated in the tape printing device, a widthwise-size setting step of setting the size of the print table image in the tape-width direction based on the tape width, a table structure inputting step of inputting the number of rows and columns defined by the table borders, a reference-table-border creating step of creating reference table borders having a plurality of reference horizontal borders and a plurality of reference vertical borders based on the set size of the print table image in the tape-width direction and the input number of rows and columns, and a print table image data editing step of editing the print table image data by changing and editing the length and position of the plurality of reference horizontal borders and the plurality of reference vertical borders.

According to the printing system and the method for processing data in the printing system, the number of reference horizontal and vertical borders is determined by the input number of rows and columns. The pitch (e.g., equal pitch) of the reference horizontal borders and the length of the vertical borders are further determined by the input number of rows and the size of the print table image in the tape-width direction that is determined by the tape width. Then, reference table borders are created. Therefore, without individually drawing horizontal borders and vertical borders of desired table borders, reference table borders having the same number of reference horizontal borders and reference vertical borders can be easily created. The reference table borders can also be created within an area corresponding to the size of the print table image in the tape-width direction, i.e., the tape width. Moreover, by changing the length and position of the reference horizontal and vertical borders based on the reference table borders, the reference table borders can be edited so that each row and column defined by the reference table borders has a desired row height and column width.

Preferably, the supply device further comprises a length-wise-size input means for inputting the size of the print table image in the tape-length direction, and the reference-table-border creating unit creates the reference table borders based on the input number of columns and the input size of the print table image in the tape-length direction.

When the size of the print table image in the tape-length direction is fixed, the pitch (e.g., equal pitch) of the plurality of reference vertical borders and the length of the plurality of horizontal borders are determined based on the input number of columns and the input size of the print table image in the tape-length direction, and reference table borders are created. In the fixed-length printing mode, therefore, the reference table borders can be created within an area corresponding to the fixed length, and a tape having a table suitable for an object to which the tape is affixed can be created.

In another aspect, this invention provides a program that causes each of the means of the printing system to function.

In another aspect, this invention provides a program that executes the steps of the above-described method.

The program of this invention is processed by a program-processible printing system. Thus, table borders can be easily created to form a print table image in a separate type of printing system.

In another aspect, this invention provides a storage medium that stores the program so as to be readable by a program-processible printing system.

The program stored in the storage medium is read and executed by a program-processible printing system. Thus, table borders can be easily created to form a print table image in a separate type of printing system.

DETAILED DESCRIPTION OF THE PREFERRED EMBODIMENTS

A printing system according to an embodiment of this invention will now be described with reference to the drawings. The printing system of this embodiment includes a tape printing device and a data server. The tape printing device itself edits desired characters such as text, number, symbol, and simple drawing, and prints the edited characters on a printing tape. The tape printing device also receives print image data stored in the data server, and prints the received print image data onto a tape. After printing, the tape printing device cuts the tape and finally creates a label.

Figure 1:
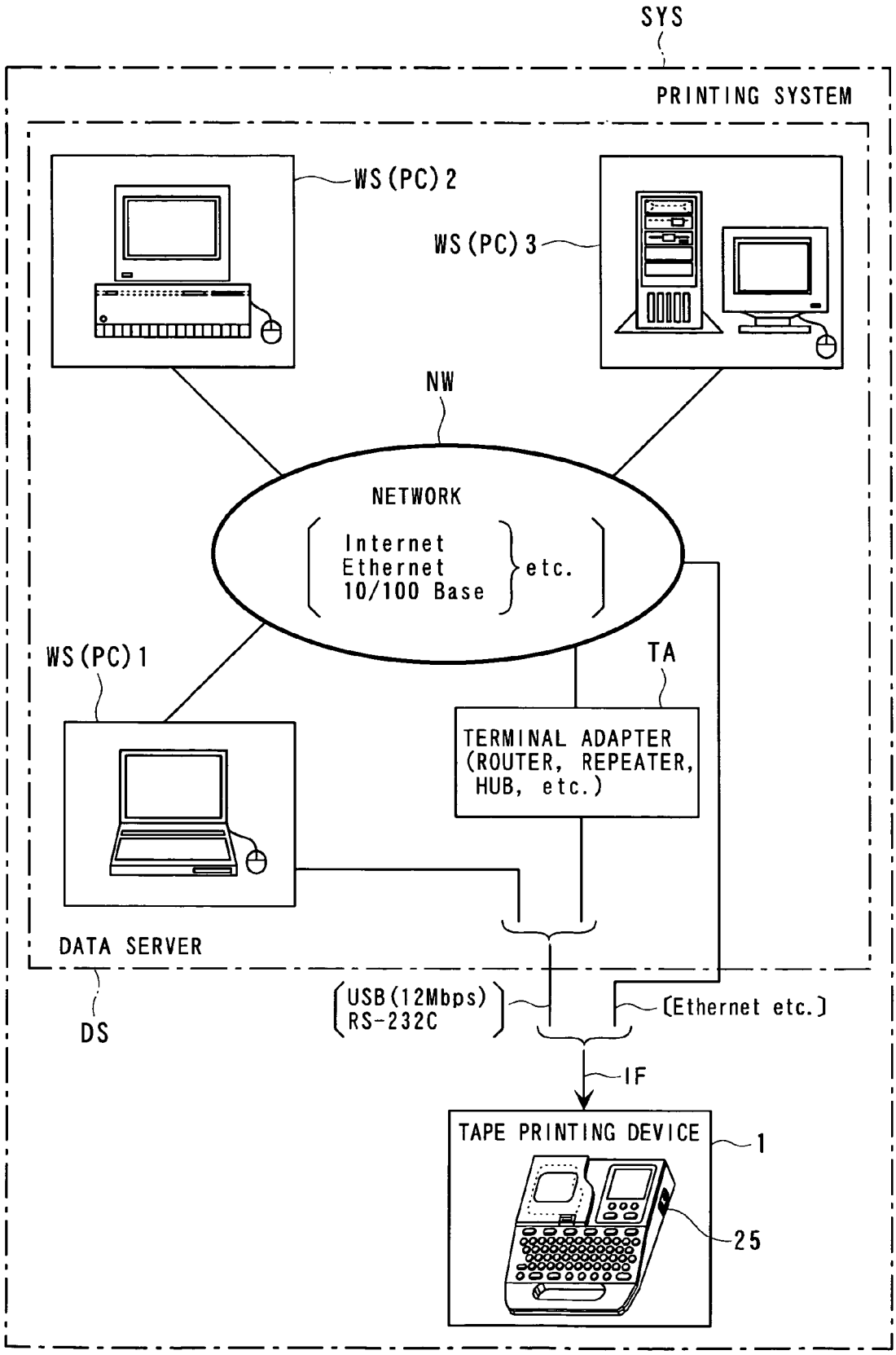
FIG. 1 is a diagram showing a first system configuration of a printing system according to an embodiment of this invention.
Figure 2:
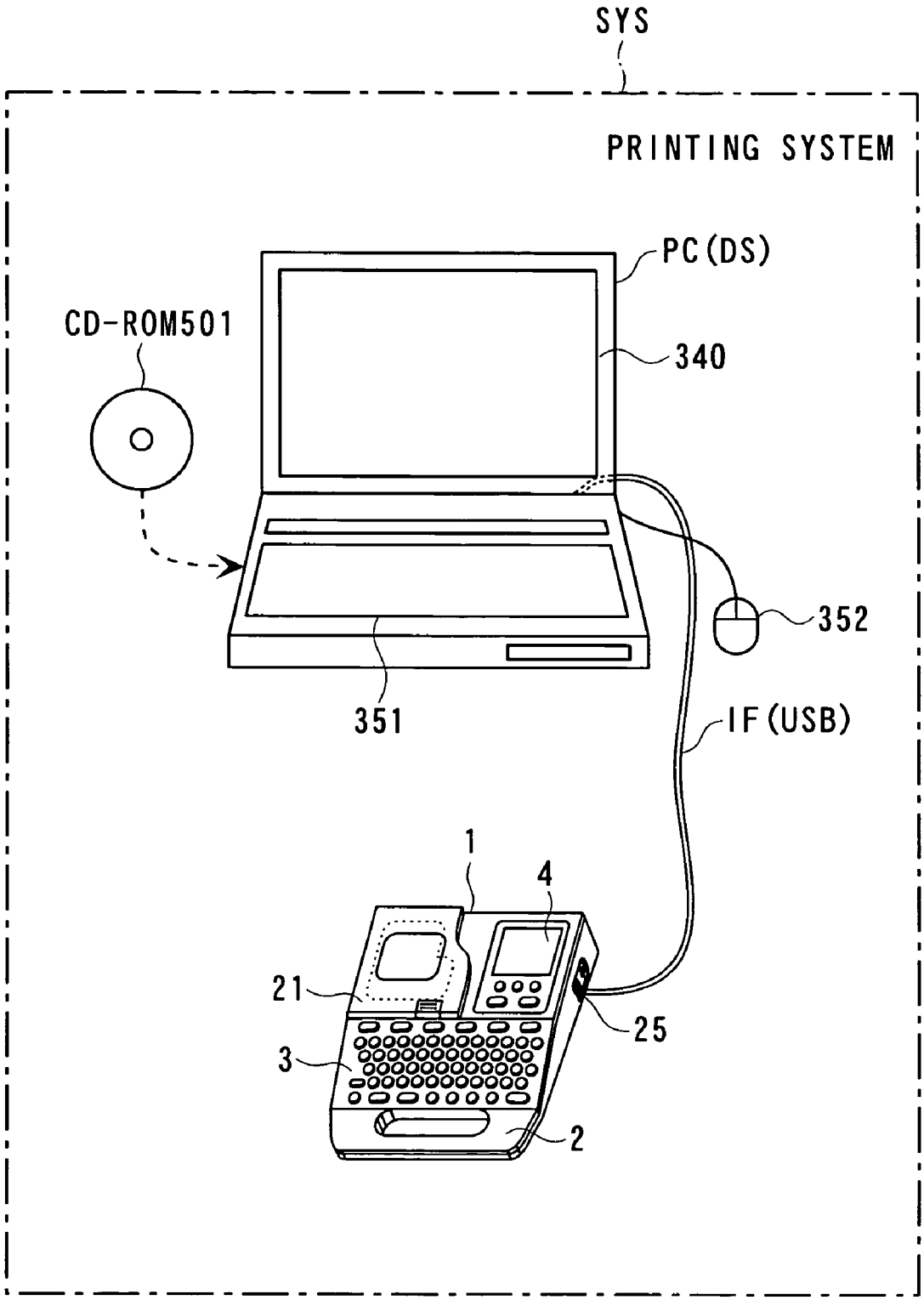
FIG. 2 is a diagram showing a second system configuration of a printing system according to an embodiment of this invention.

As shown in FIGS. 1 and 2, a printing system SYS itself is regarded as a single tape printing apparatus (separate type of tape printing apparatus). The printing system SYS includes a data server DS serving as a supply device, and a tape printing device 1, and the data server DS and the tape printing device 1 are connected via an interface IF.

The data server DS supplies to the tape printing device 1 print image data to be printed. For example, in a first configuration of the printing system SYS shown in FIG. 1, the data server DS includes a plurality of workstations WS1 to WS3, such as personal computers PC, serving as terminals, and terminal adapters TA (including a router, a repeater, a hub, and so on), etc., which are connected via a network NW. The data server DS is connected via the interface IF from any terminal or as a direct interface IF from the network NW to the tape printing device 1.

The network NW may be a network complying with the IEEE standard LAN communication protocol, e.g., the Internet or a local area network (LAN), such as Ethernet® or 10/100 Base. The interface IF that interfaces with the terminals may be a serial data communication interface such as an RS-232C, USB, or IEEE 1394 interface, or a parallel data communication interface such as a Centronics interface. Instead of such a wire communication standard, a wireless communication standard may be used.

Alternatively, and more simply, the data server DS may be a stand-alone device. For example, in a second system configuration of the printing system SYS shown in FIG. 2, the printing system SYS is constructed merely by connecting a stand-alone personal computer PC to the tape printing device 1 via an interface IF such as a USB interface.

Figure 3:
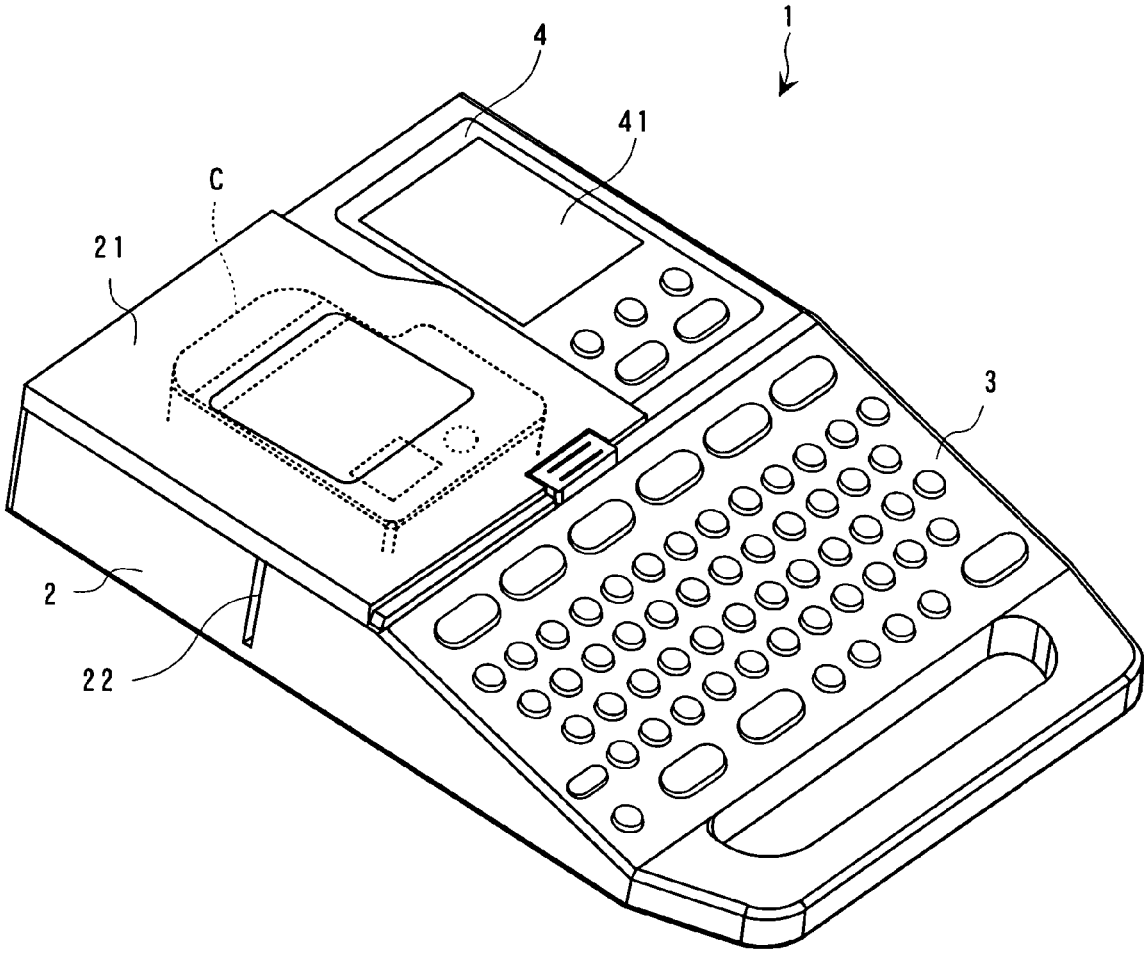
FIG. 3 is an external perspective view of a tape printing device shown in FIG. 1 or 2.
Figure 4:
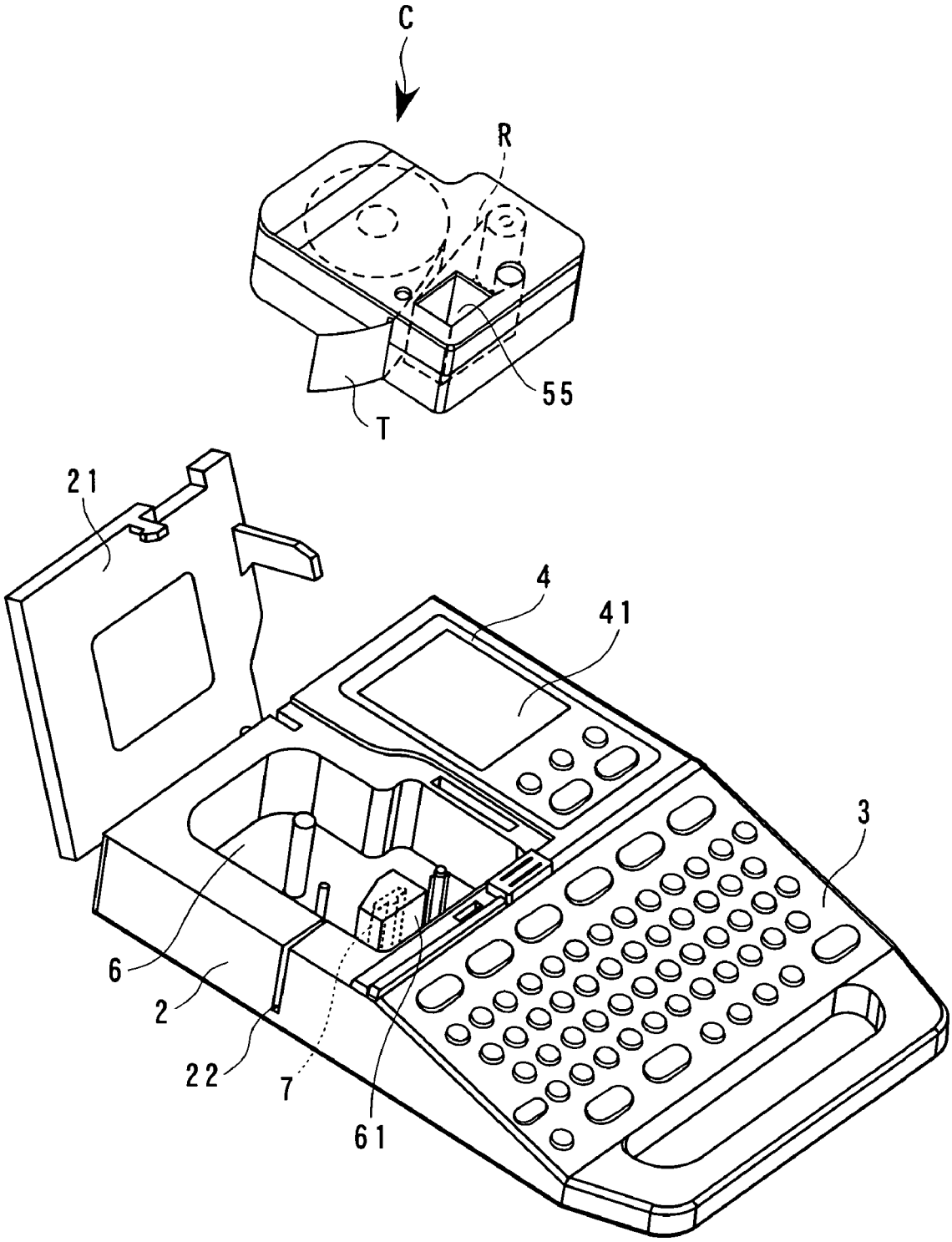
FIG. 4 is a perspective view of the tape printing device whose cover is open.

The tape printing device 1 will now be briefly described. As shown in FIGS. 3 and 4, the tape printing device 1 includes a device case 2 that defines the outer contour of the tape printing device 1. A keyboard 3 having a variety of input keys is provided at the front of the top face of the device case 2. At the rear of the top face of the device case 2, an opening/closing cover 21 and a display 4 are provided at the left and right portions, respectively. A slit-shaped tape outlet 22 is formed in the left side portion of the device case 2 for communicating a tape accommodating portion 6 with the outside of the tape printing device 1. Although not shown in FIGS. 3 and 4, the tape outlet 22 is confronted with a tape cutter 132 for cutting a printing tape (hereinafter referred to simply as a "tape") passing through the tape outlet 22.

Figure 5:
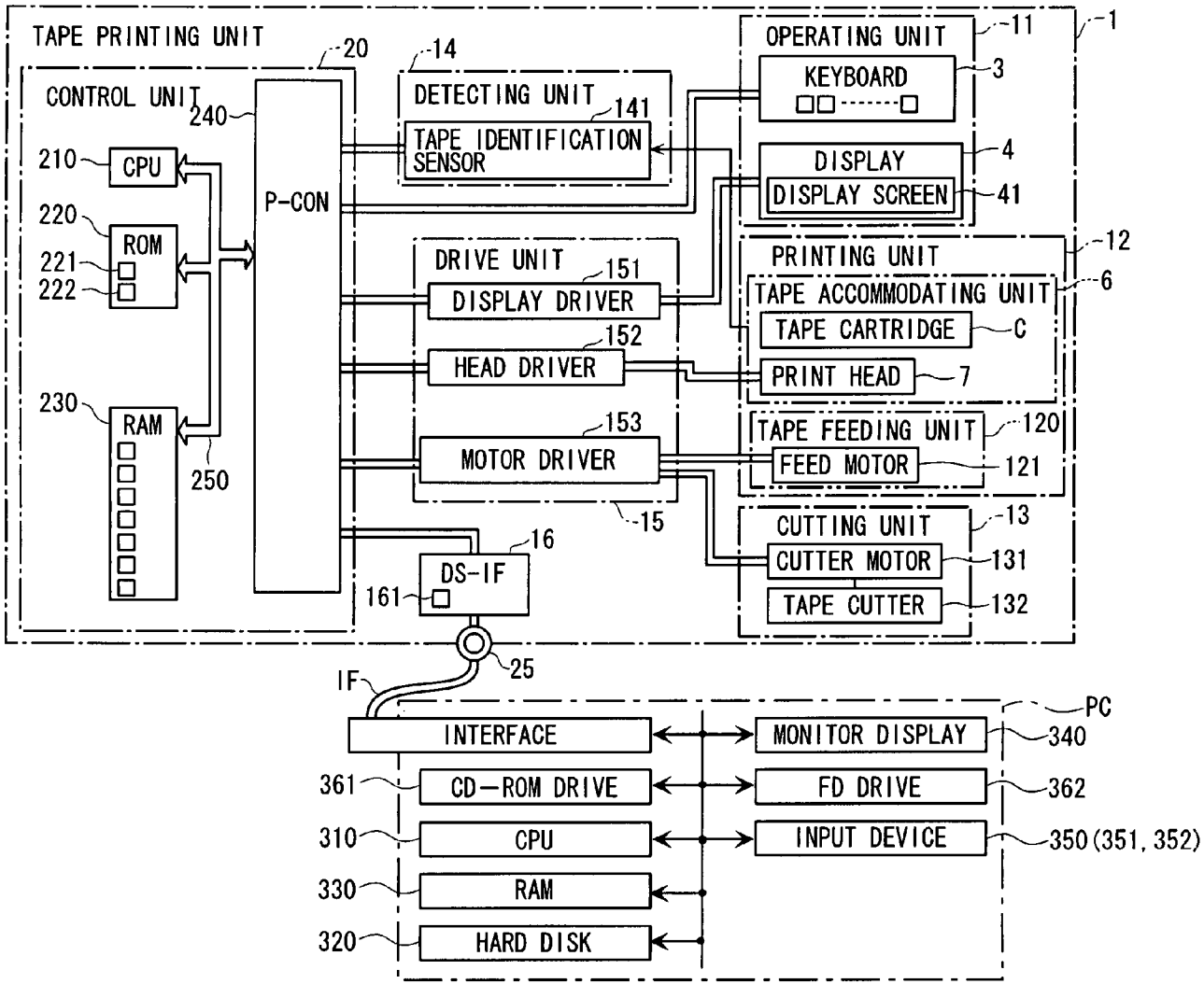
FIG. 5 is a schematic block diagram of the control system in the second system configuration of the printing system.

As shown in FIG. 5, the tape printing device 1 is configured so that a data supply interface (DS-IF) 16 is added to the structure of a stand-alone tape printing device. For example, in the second system configuration shown in FIG. 2, the DS-IF 16 communicates with the data server DS via a USB connector 25 from the interface IF in accordance with the USB specification. The DS-IF 16 includes a receiving buffer 161 for receiving various types of data such as print image data from the data server DS.

In view of the control system, basically, the tape printing device 1 includes an operating unit 11 that has the keyboard 3 and the display 4 and that interfaces with the user, a printing unit 12 that has a printhead 7 composed of a thermal head and a tape feeding unit 120 and that prints on a tape T of a tape cartridge C accommodated in the tape accommodating unit 6, a cutting unit 13 that cuts the tape T after printing using the tape cutter 132, a detecting unit 14 that has various sensors and that detects the tape T, etc., a driving unit 15 that has various drivers and that drives various circuits, and a control unit 20 that controls the DS-IF 16 and the internal components of the tape printing device 1.

As described above, the user may use the tape printing device 1 in a stand-alone manner to create a label L onto which desired characters etc., are printed. In this case, after installing the tape cartridge C into the tape accommodating unit 6, the user inputs print information, such as desired characters, using the keyboard 3 while viewing the input or edited data on the display 4. When the user instructs printing, the tape T is fed from the tape cartridge C by the tape feeding unit 120, and desired data is printed onto the tape T by the printhead 7. The printed portion can be discharged to the outside from the tape outlet 22 at any time. After printing, the tape feeding unit 120 feeds the tape T to the position of a certain tape length, including margins, and stops feeding the tape T for cutting.

A plurality of tapes T received in tape cartridges C, e.g., seven tapes having widths of 4 mm, 6 mm, 9 mm, 12 mm, 18 mm, 24 mm, and 36 mm, are prepared. Each tape cartridge C has a plurality of small holes (not shown) in the rear side thereof for identifying the received tape T. The tape accommodating unit 6 includes a tape identification sensor 141 composed of micro-switches for detecting the holes, and determines the type of the tape, including the width of the tape T. Thus, the bits represented by a combination of the plurality of holes and the plurality of switches can be identified.

The tape feeding unit 120 is disposed in the rear surface of the tape accommodating unit 6. The tape feeding unit 120 includes a feed motor 121 serving as an actuator, and feeds the tape T and an ink ribbon R in an overlapping manner at the position of a through-hole 55 in synchronization with a printing operation. After passing through the printhead 7, only the printed tape T is discharged from the tape outlet 22 to the outside, whereas the ink ribbon R is wound back in the tape cartridge C.

The cutting unit 13 includes the tape cutter 132 and a cutter motor 131 for driving the cutting operation of the tape cutter 132. The driving operation of the cutter motor 131 is carried out automatically or manually depending upon the mode. The cutter motor 131 is driven by a manual cut-key operation in an arbitrary-length printing mode for printing within an area of a tape length (arbitrary length) corresponding to, e.g., the length of an input character string. In a fixed-length printing mode for printing within an area of the tape length (fixed length) specified by the user, the cutter motor 131 is driven automatically.

The detecting unit 14 includes the tape identification sensor 141, and various other sensors that are disposed in the components of the device. The driving unit 15 includes a display driver 151, a head driver 152, and a motor driver 153. The display driver 151 drives the display 4 of the operating unit 11 according to instructions based on control signals output from the control unit 20. Likewise, the head driver 152 drives the printhead 7 of the printing unit 12, and the motor driver 153 drives the motors, such as the feed motor 121 of the printing unit 12 and the cutter motor 131 of the cutting unit 13.

The operating unit 11 includes the keyboard 3 and the display 4. Various instructions and data are input from the keyboard 3 to the control unit 20 using the various keys. The display 4 includes a display screen 41 in which display image data is displayable, and 18 indicators (not shown) indicating various setting states. Using the display 4, the user inputs data from the keyboard 3 to create or edit print image data such as character strings, visually confirms the created or edited data, or inputs various instructions and selection commands from the keyboard 3.

The control unit 20 includes a central processing unit (CPU) 210, a read-only memory (ROM) 220, a random access memory (RAM) 230, and a peripheral control circuit (P-CON) 240, and these components are connected via an internal bus 250. The ROM 220 has a control program area 221 for storing a control program to be processed by the CPU 210, and a control data area 222 for storing data prepared in the device, such as character font data, a color conversion table, and a text modification table. The RAM 230 is backed up at power-off time. The RAM 230 has areas, such as a text data area, which are used as work areas for various operations.

The P-CON 240 functions as an auxiliary to the CPU 210, and includes a logic circuit for handling an interface signal with a peripheral circuit and a functional circuit such as a timer for counting various times in the form implemented by a gate array, a custom LSI, or the like. The P-CON 240 is connected with the sensors of the detecting unit 14, the keyboard 3, and the DS-IF 16, and fetches various detection signals from the detecting unit 14, various instructions and input data from the keyboard 3, and control signals and various types of downloaded data from the data server DS, either as is or modified, into the internal bus 250. In association with the CPU 210, the P-CON 240 outputs the data or control signals output to the internal bus 250 from the CPU 210, etc., either as is or modified, to the driving unit 15 or the DS-IF 16.

According to the control program stored in the ROM 220, the CPU 210 receives various detections signals, various instructions, various types of data, etc., via the P-CON 240, processes the data, etc., stored in the ROM 220 or the RAM 230, and outputs control signals to the driving unit 15 and the DS-IF 16 via the P-CON 240. Thus, while communicating (transmitting and receiving) the control signals and data to and from the data server DS via the interface IF, the CPU 210 controls the printing position and the display of the display screen 41. The CPU 210 also controls the printhead 7 so as to print on the tape T under predetermined printing conditions. Therefore, the CPU 210 controls the overall tape printing device 1.

A control process flow of the tape printing device 1 will now be described with reference to FIG. 6. When a power key is pressed or turned on, the process starts. First, an initial setting, such as recovery of saved control flags, is performed to restore the previous state before power-off (step S1). Then, the previous display screen 41 is presented as the initial screen (step S2).

Figure 6:
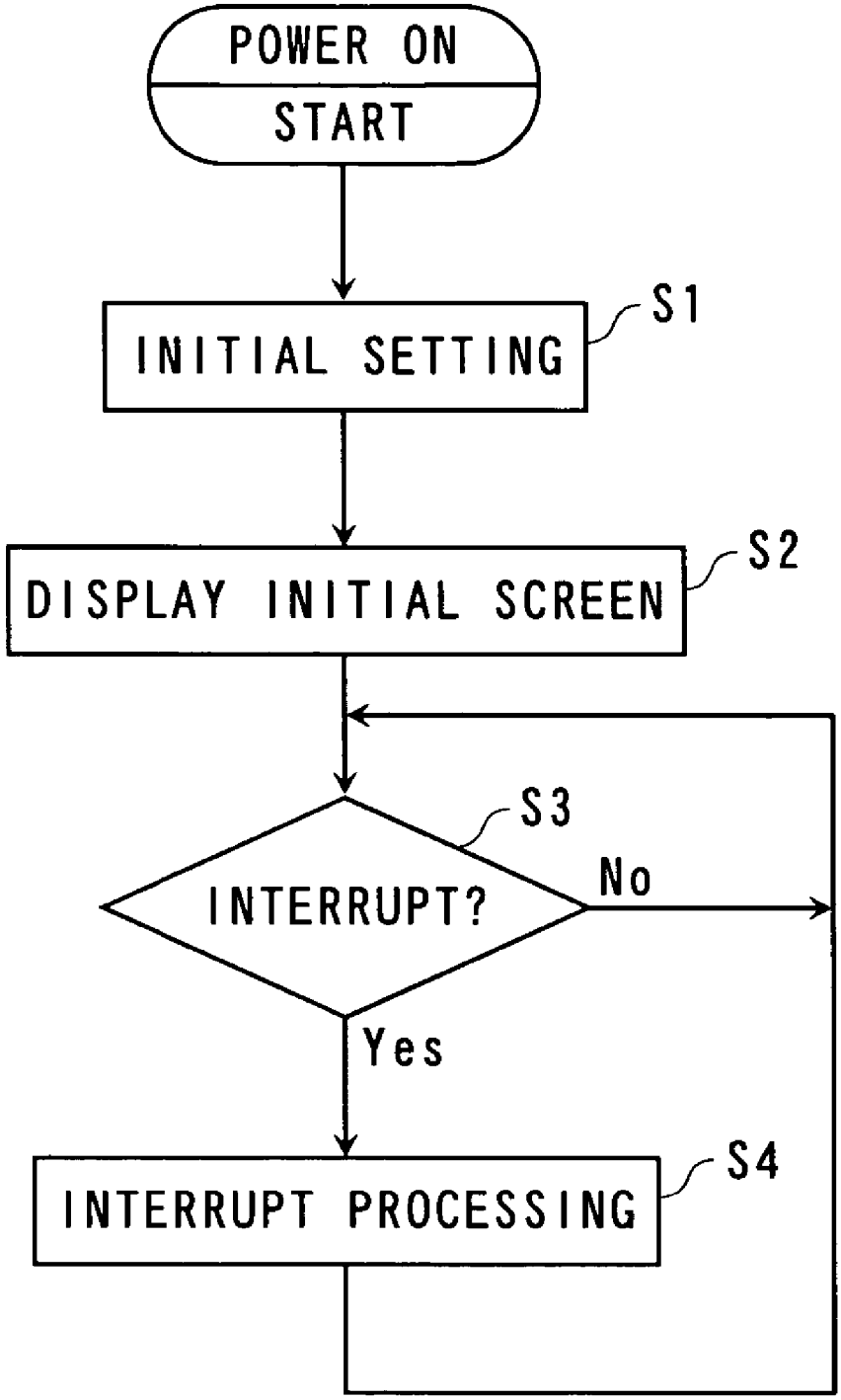
FIG. 6 is a flowchart schematically showing an overall control process for the tape printing device.

The subsequent steps, i.e., a key-input determination step S3 and an interrupt step S4, are shown conceptually in FIG. 6. Actually, after the initial display screen (step S2), an interrupt caused by key input or the like is permitted in the tape printing device 1. The tape printing device 1 maintains the current state until an interrupt occurs (NO in step S3). When an interrupt occurs (YES in step S3), the corresponding interrupt processing is performed (step S4). After the interrupt processing, the tape printing device 1 maintains the state (NO in step S3).

In this way, the main processing of the tape printing device 1 is implemented by the interrupt processing. Thus, once a print image has been created, the user can press a print key at any time to cause a print interrupt, thereby activating the printing operation to print the print image based on the print image data. That is, the user is free to start printing.

Figure 7A:
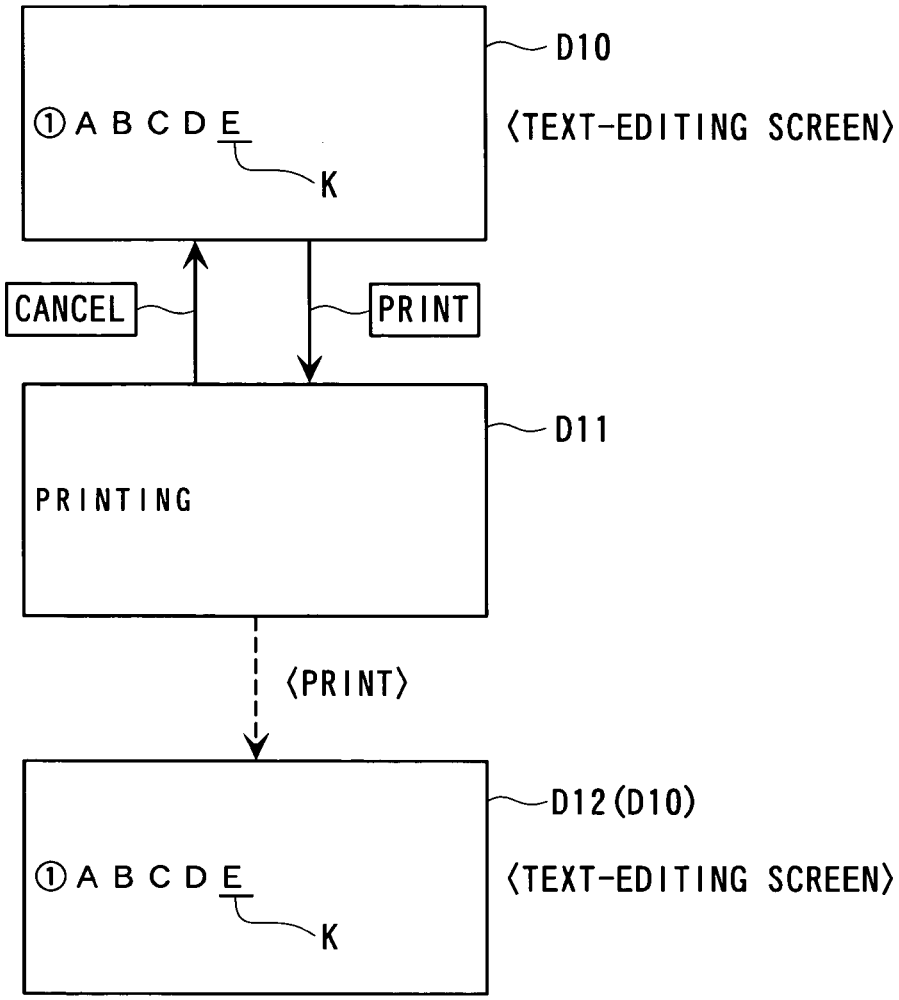
FIG. 7A is a diagram showing display screens for printing and a typical printing operation on the display screens.
Figure 7B:
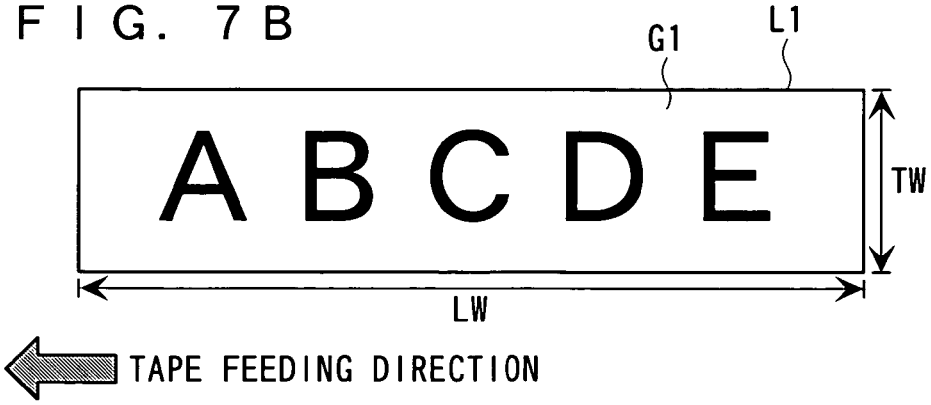
FIG. 7B is a diagram showing a printed character string after the printing operation shown in FIG. 7A.

For example, as shown in FIG. 7A, characters "A", "B", "C", "D", and "E" are sequentially entered using the character keys of the keyboard 3, and a character string "ABCDE" is displayed in a first row on the display screen 41 (i.e., a text-editing screen). When the user presses the print key in the state where a cursor K is positioned at the end of the character string "ABCDE" on the display screen 41 (D10; the display state of the display screen 41 is hereinafter indicated by "Dxx"), a "printing" message is displayed (D11), and the character string "ABCDE" is printed as a print image G1 onto a tape. The tape is then cut according to the setting to create a label L1 (see FIG. 7B). After printing, the initial text-editing screen (D12, i.e., D10) appears again. In the tape printing device 1, the user can use a cancel key to cancel various instructions performed by key input. By pressing the cancel key in the "printing" screen (D11), the current screen can be returned to the initial text-editing screen (D10).

Accordingly, the tape printing device 1 of the present embodiment edits and prints a desired character string (e.g., "ABCDE") in a stand-alone manner. As described above, the tape printing device 1 may also print a print image based on the print image data prepared in the data server DS. In the first system configuration shown in FIG. 1, the print image data prepared or stored in the devices WS1 to WS3 and TA in the data server DS is downloaded and is then printed. In the second system configuration shown in FIG. 2, for example, the print image data stored in the personal computer PC serving as the data server DS is obtained and is then printed. The following description will be made in the context of the printing system SYS having the relatively simple second system configuration.

A personal computer PC is capable of supplying print image data such as print table image data indicating table borders having a plurality of horizontal borders and a plurality of vertical borders for defining table rows and columns to the tape printing device 1 via the interface IF. As shown in FIG. 5, the personal computer PC includes a RAM 330, a hard disk 320, and a CPU 310, and these components are connected with one another via a bus. The RAM 330 has a storage area capable of temporarily storing data, and is used as a work area for control processing. The hard disk 320 has various storage areas for storing control programs and various types of data. The CPU 310 performs computation on various types of data based on the programs and the like stored in the hard disk 320. The personal computer PC further includes a monitor display 340 for visual confirmation of the user for displaying various types of data and messages, a known input device 350 including a keyboard 351 and a mouse 352 (see FIG. 2), and known drives such as a compact disk (CD or CD-ROM) drive 361 and an floppy disk or flexible disk (FD) drive 362. The hard disk 320 has print table image creating software installed therein for loading the data input using the keyboard 351 and the mouse 352 or the image data read from a CD-ROM 501 (see FIG. 2) to create or edit reference table borders 421, described below, and for editing the print table image data.

In the following description, pressing the function keys on the personal computer PC or pointing various pointing devices such as the mouse 352 is represented by left-clicking a mouse pointer, and is referred to as a "click". Right-clicking the mouse pointer is referred to as a "right-click".

Figure 8A:
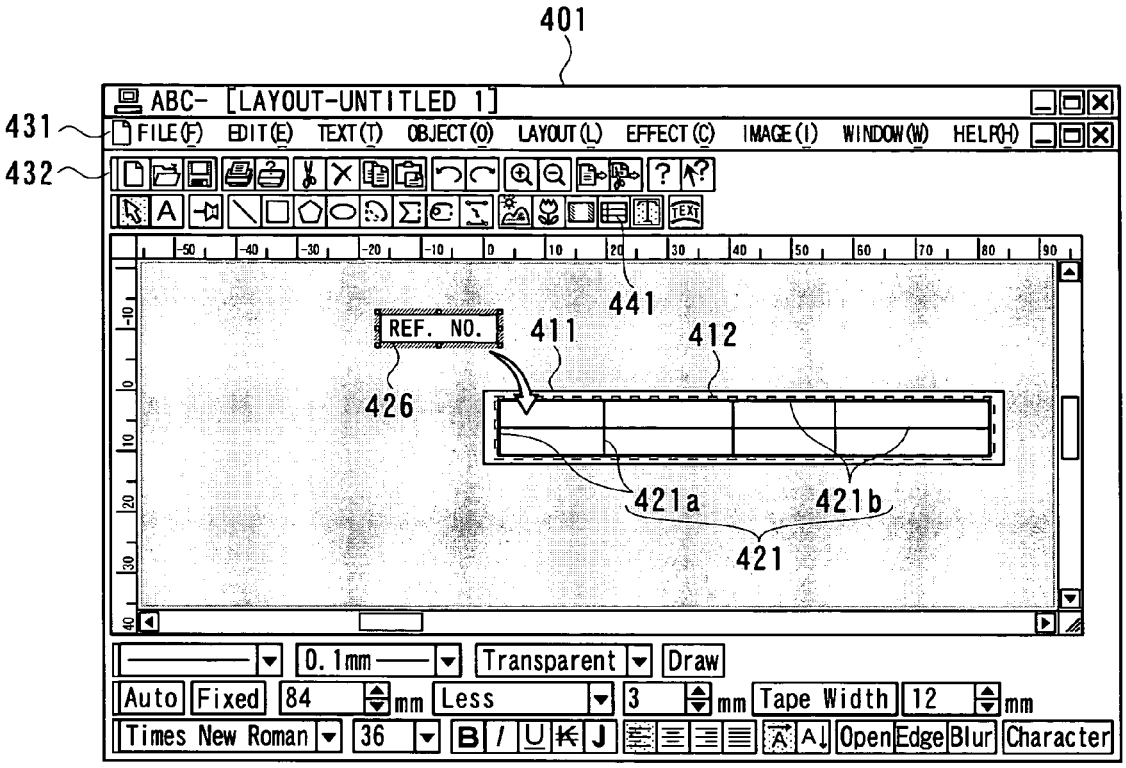
FIG. 8A is a layout-editing screen showing a process for editing reference table borders.

As shown in FIG. 8A, a layout-editing screen 401 is shown as a so-called window on the monitor display 340 of the personal computer PC. Print image data such as print table image data is editable on the layout-editing screen 401.

The personal computer PC is also capable of determining the width of the tape T accommodated in the tape printing device 1 (hereinafter referred to as "tape width TW"). In the tape printing device 1, the tape identification sensor 141 can be used to detect the type of the tape T, including the tape width TW, and this detection is reported to the personal computer PC via the interface IF.

In this case, the tape printing device 1 may determine (analyze) the tape width TW based on the detected type of the accommodated tape T (actually, the type of the tape T is detected via the tape cartridge C), and may report information about the tape width TW. Alternatively, the tape printing device 1 may send information about the type of the tape T, and the personal computer PC may analyze the tape width TW. The tape printing device 1 may send the information to the personal computer PC each time a new tape cartridge C is installed in the tape printing device 1, and the personal computer PC may store the information. Alternatively, in response to a request from the personal computer PC, the tape printing device 1 may send the information to the personal computer PC.

The layout-editing screen 401 has a menu bar 431. In a "tape setting" option in a "file" menu of the menu bar 431, the arbitrary-length printing mode or the fixed-length printing mode is selectable. When the user selects the fixed-length printing mode, a desired fixed length LW (e.g., 84 mm) is input. In the "tape setting" option, the margin sizes (e.g., top and bottom margins of 1.9 mm and right and left margins of 3.6 mm) for printing on the tape T are set. Based on the fixed length of 84 mm, the top and bottom margins of 1.9 mm, the right and left margins of 3.6 mm, and the tape width TW of 12 mm, the size of a print table image GT is set to 8.2 mm in height by 76.8 mm in width.

On the layout-editing screen 401, a label image 411 defined by the tape width TW and the fixed length LW, and a printable area 412 defined by the size of the print table image GT are shown. In the printable area 412, the user edits the reference table borders 421 having reference vertical borders 421*a* and reference horizontal borders 421*b*, described in detail below, and edits the print table image data. A text image 426 (e.g., a print text image GX, such as "Ref No.", "C-001-001", "Inventory Name", "PC", "Date of Purchase", "2003.3.20", "Managing Dept.", or "Information System Dept." shown in FIG. 8B) is placed in each cell defined by the edited reference table borders 421 (table borders), and the print text image data is edited.

Figure 8B:
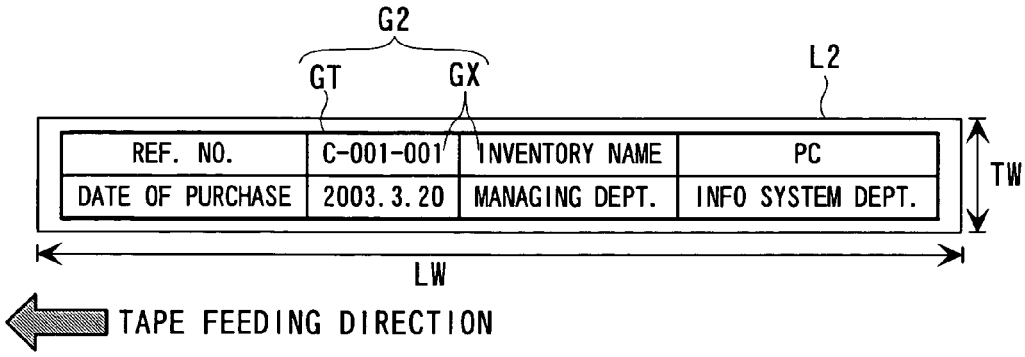
FIG. 8B is a diagram showing a print table image based on the print table image data obtained by editing the reference table borders.

After editing the table borders (i.e., the print table image data) and the character images (i.e., the print text image data) on the layout-editing screen 401, for example, when the user instructs (selects and clicks) a "print" option in the "file" menu of the menu bar 431 and selects the tape printing device 1 as the specified printer, the personal computer PC executes the instructed "print" operation while showing a "printing" message or as a background (without showing the message). Specifically, the personal computer PC transmits print image data that is created from the print table image data and the print text image data, and cut instruction data (or a cut instruction signal) instructing the desired cut type and timing to the tape printing device 1 via the interface IF. In FIG. 8B, a full cut at the trailing end in the tape feeding direction is instructed.

While receiving the print image data and the cut instruction data via the DS-IF 16, the tape printing device 1 prints a print image G2 having the print table image GT and the print text images GX. Then, the tape printing device 1 performs a full cut at the trailing end to create a label L2.

Depending upon the specification, data (e.g., the print table image data) for creating the print image G2 may be transmitted from the personal computer PC to the tape printing device 1 via the interface IF, and the tape printing device 1 may create the print image data and the label L2. In the present embodiment, either the data or control signals are communicated via the interface IF between the personal computer PC and the tape printing device 1. However, various control signals may be exchanged (instructed and transmitted/received) via another interface.

Accordingly, the personal computer PC is capable of creating and editing print table image data of table borders. The details of a process for creating and editing print table image data of table borders will now be described.

Figure 9:
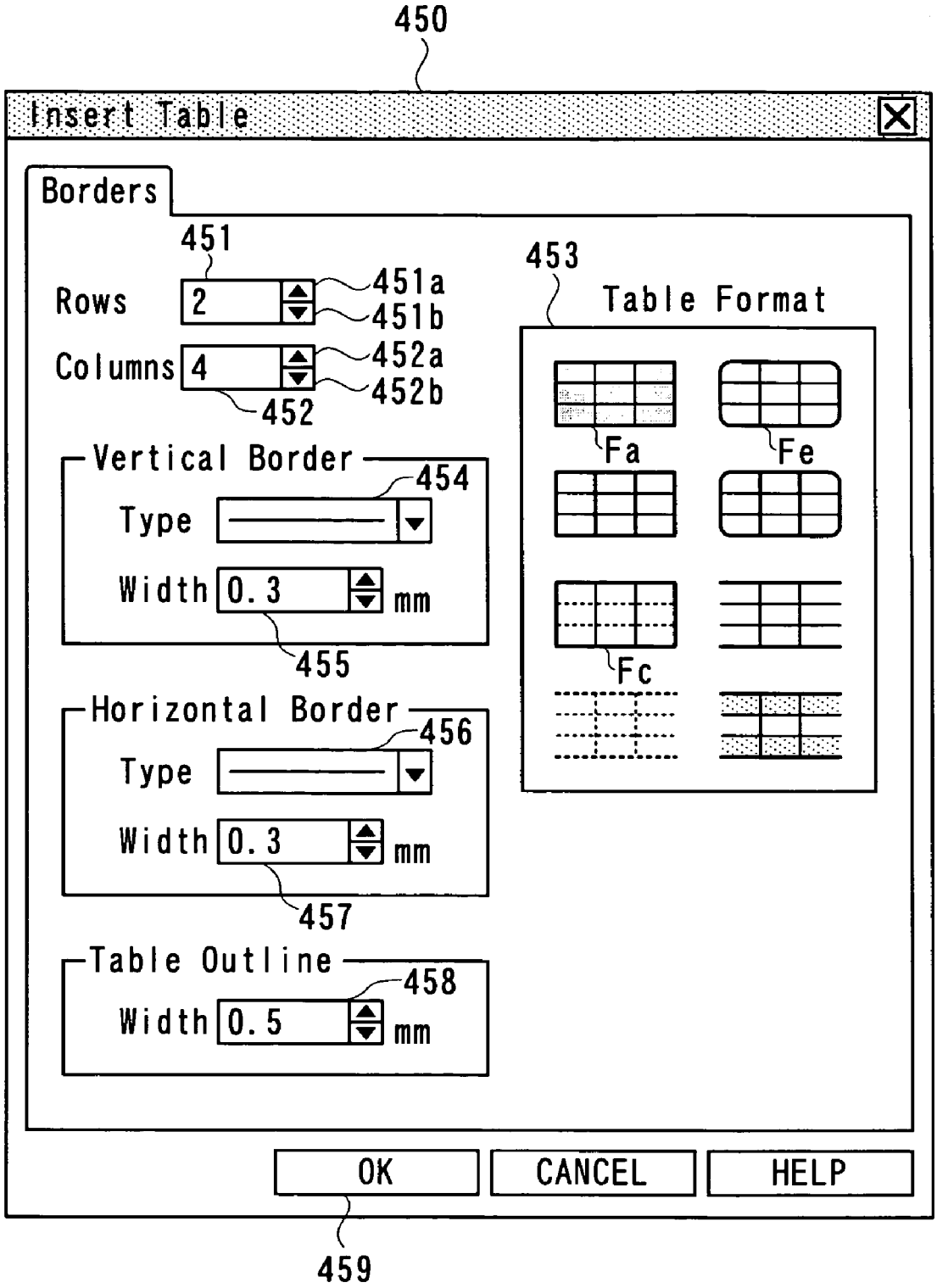
FIG. 9 is a table creating dialog box.

When the user instructs (selects and clicks) a "table" option in an "insert" menu of the menu bar 431 or clicks a "table" button 441 in a tool bar 432 on the layout-editing screen 401 (see FIG. 8A), as shown in FIG. 9, a table creating dialog box 450 is displayed. In the table creating dialog box 450, the user can create and edit the reference table borders 421 as a reference of the table borders that become the print table image GT.

More specifically, in the table creating dialog box 450, first, a value indicating the number of desired table rows, e.g., "2", is entered in a row-number input text box 451, or an up-arrow button 451*a* and a down-arrow button 451*b* are clicked to enter the desired value. A value indicating the number of desired table columns, e.g., "4", is also entered in a column-number input text box 452, or an up-arrow button 452*a* and a down-arrow button and 452*b* are clicked to enter the desired value.

The default value of the row-number input text box 451 is "3", and a value ranging from 1 to 20 is acceptable. The default value of the column-number input text box 452 is "2", and a value (an integer) ranging from 1 to 20 is acceptable. If a value other than the acceptable values is entered, an error indication is displayed. The maximum (or minimum) acceptable value is not increased (or decreased) even when the up-arrow button 451*a* or 452*a* (or the down-arrow button 451*b* or 452*b*) is clicked. The maximum acceptable value to be entered in the row-number input text box 451, i.e., the maximum number of rows, may be limited based on the tape width TW reported by the tape printing device 1. For example, the maximum number of rows is set to "3" for the tape width TW of 9 mm, and the maximum number of rows is set to "6" for the tape width TW of 18 mm. In the fixed-length printing mode, the maximum acceptable value to be entered in the column-number input text box 452, i.e., the maximum number of columns, may be limited based on the input tape length. For example, the maximum number of columns is set to "10" for a tape length of 30 mm, and the maximum number of columns is set to "20" for a tape length of 60 mm. Thus, the plurality of reference horizontal borders 421*b* and the plurality of reference vertical borders 421*a* are designed so that each row and column in the print table image has a desired row height (e.g., 3 mm) and column width (e.g., 3 mm). This prevents the row height of the plurality of rows and the column width of the plurality of columns from being excessively reduced by extra input operations for the number of rows and columns. The row height of 3 mm and the column width of 3 mm are limited based on a minimum font size of 6 points. In this case, a single six-point character can be entered in each cell.

In a table-format selecting screen 453 of the table creating dialog box 450, a table format F of the reference table borders 421 (i.e., a table border form) is further specified. The table-format selecting screen 453 contains, for example, a table format Fa in which the reference table border 421 that defines the table outline is thicker than other reference table borders 421, a table format Fc in which the horizontal interior borders are dotted lines, a table format Fe in which the reference table border 421 that defines the table outline is rectangular with round corners, and so on. Any table format F (e.g., the table format Fa) can be specified. The line type (e.g., a solid line, a dotted line, broken line, a one-dot chain line, no line (a transparent line), etc.) and width of the reference vertical borders 421*a* and the reference horizontal borders 421*b* (in this case, the vertical and horizontal interior borders) of the reference table borders 421 can be separately specified in a vertical-border-type selecting list box 454, a vertical-border-width input text box 455, a horizontal-border-type selecting list box 456, and a horizontal-border-width input text box 457. The width of the reference table border 421 that defines the table outline can also be specified in a table-outline-width input text box 458. These boxes allow the format of the reference table borders 421 to be set with more variation based on the table format F contained in the table-format selecting screen 453.

Figure 10:
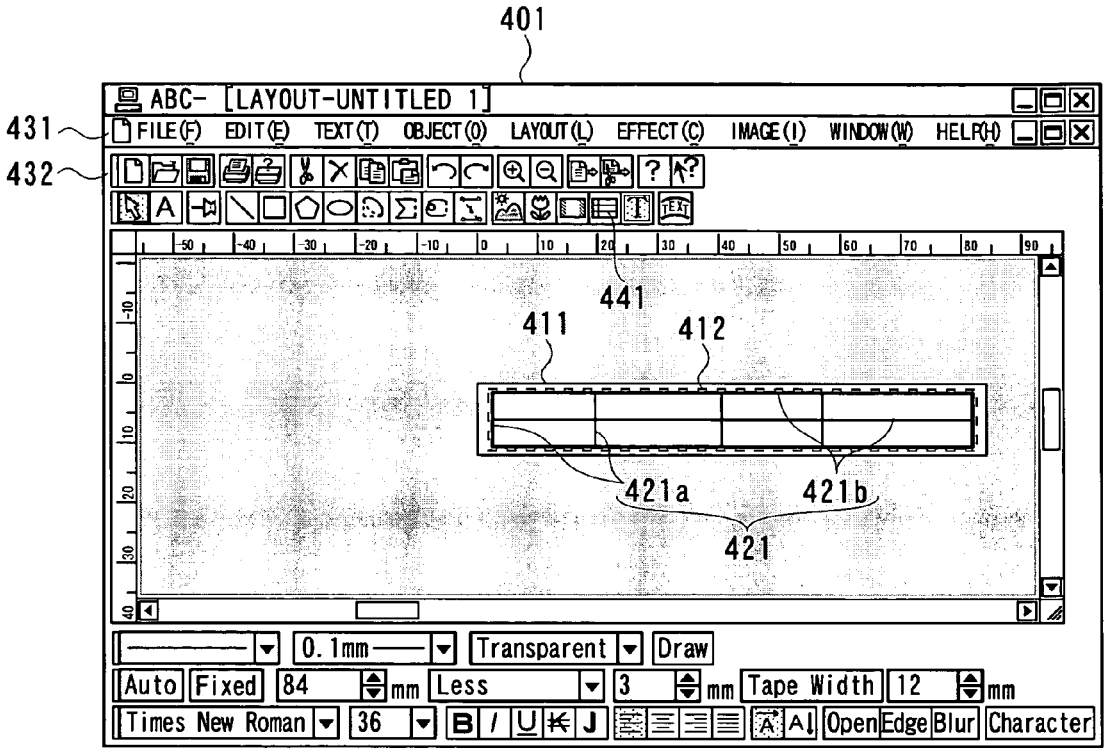
FIG. 10 is a layout-editing screen showing reference table borders that are created based on the input data in the table creating dialog box shown in FIG. 9.

After entering the number of rows and columns and the format of the reference table borders 421, when the user clicks an OK button 459 in the table creating dialog box 450, the table creating dialog box 450 is closed. As shown in FIG. 10, the label image 411 and the printable area 412 are shown in the layout-editing screen 401, and the reference table borders 421 are also shown based on the number of rows "2", the number of columns "4", and the format "table format Fa" specified in the table creating dialog box 450 and based on the tape width TW of 12 mm and the fixed length LW of 84 mm. That is, based on the tape width TW of 12 mm (actually, the size of the print table image GT in the tape width direction, taking margins into consideration, i.e., 8.2 mm) and the input number of rows "2", the pitch of the three reference horizontal borders 421*b* (i.e., the row height) is set to, e.g., 4.1 mm equally, and the length of the five reference vertical borders 421*a* is set to 8.2 mm. Based on the fixed length of 84 mm (actually, the size of the print table image GT in the tape length direction, taking margins into consideration, i.e., 76.8 mm) and the input number of columns "4", the pitch of the five reference vertical borders 421*a* (i.e., the column width) is set to, e.g., 19.2 mm equally, and the length of the three reference horizontal borders 421*b* is set to 76.8 mm. Based on the reference table border form, i.e., the "table format Fa", the type and width of the reference table border 421 and the reference horizontal borders 421*b* are set. Therefore, without individually drawing horizontal borders and vertical borders of desired table borders, reference table borders 421 having the same number of reference horizontal borders 421*b* and reference vertical borders 421*a* can be easily created. The reference table borders 421 can also be created within an area corresponding to the size of the print table image GT in the tape-width direction (i.e., the tape width TW).

In the arbitrary-length printing mode, the pitch of the reference vertical borders 421*a* is set to a predetermined value (e.g., 10 mm). Based on this value, the pitch of the reference vertical borders 421*a* and the length of the plurality of reference horizontal borders 421*b* are determined, and the reference table borders 421 are created.

Figure 11A:
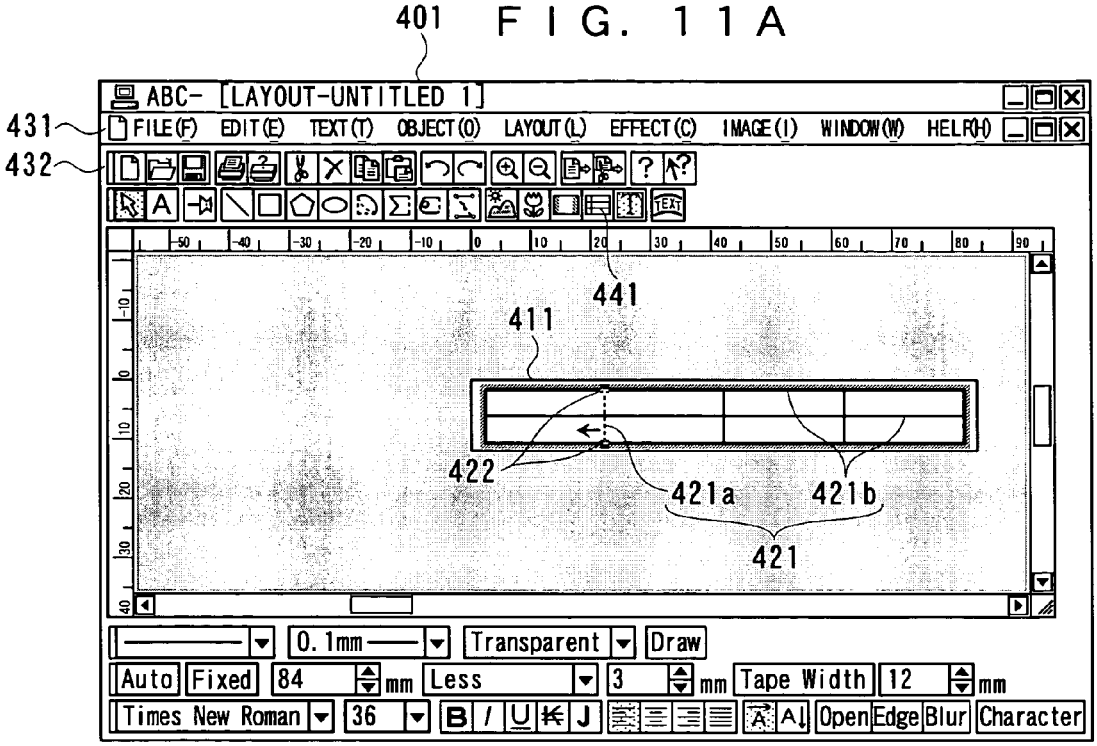
FIGS. 11A and 11B are layout-editing screens showing a process for changing the position of a reference vertical interior border of the reference table borders shown in FIG. 10.
Figure 11B:
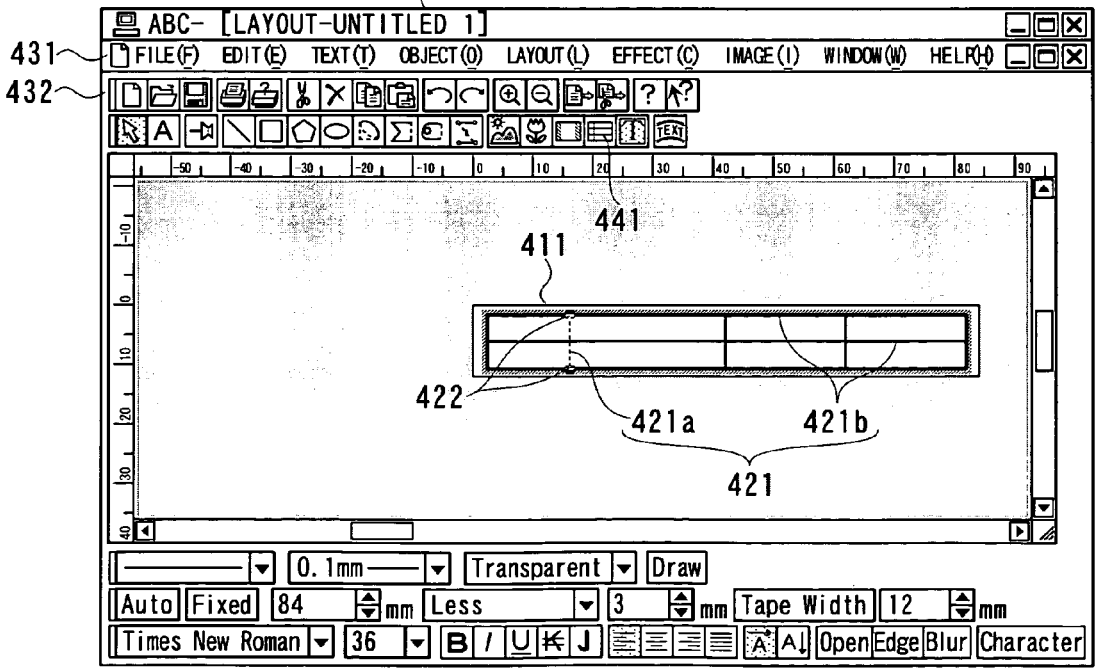
Figure 12A:
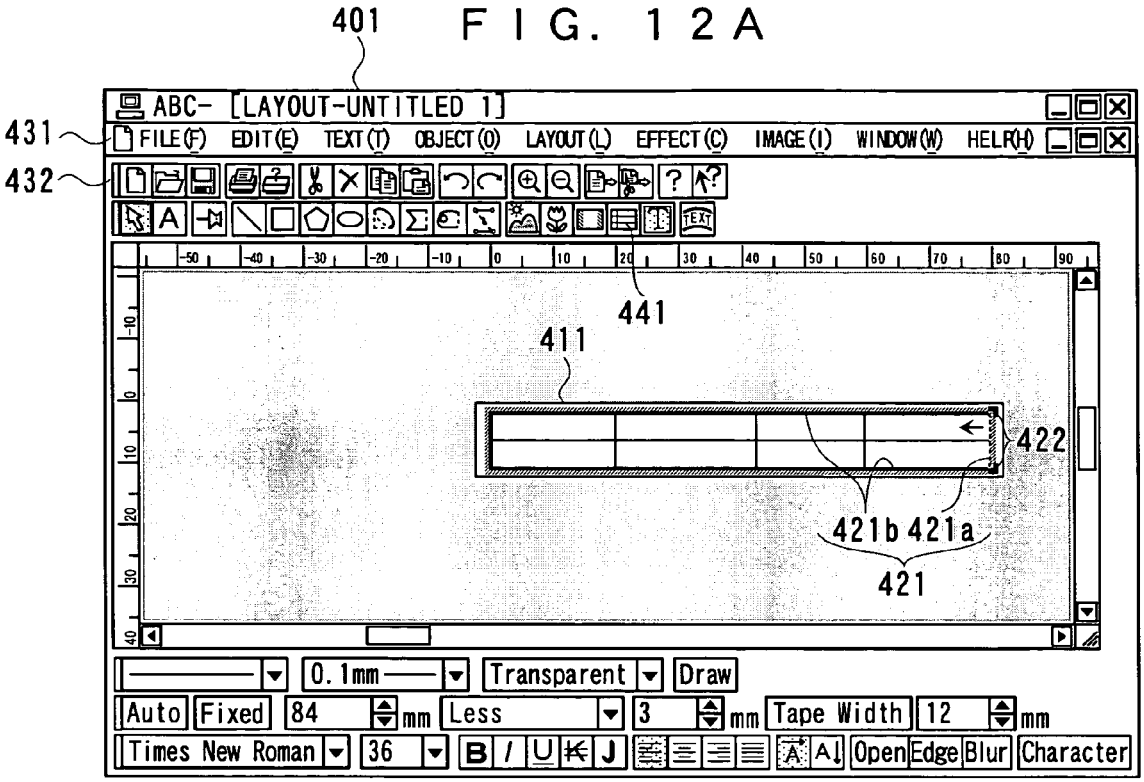
FIGS. 12A and 12B are layout-editing screens showing a process for changing the position of a reference horizontal border of the reference table shown in FIG. 10 that defines the table outline.
Figure 12B:
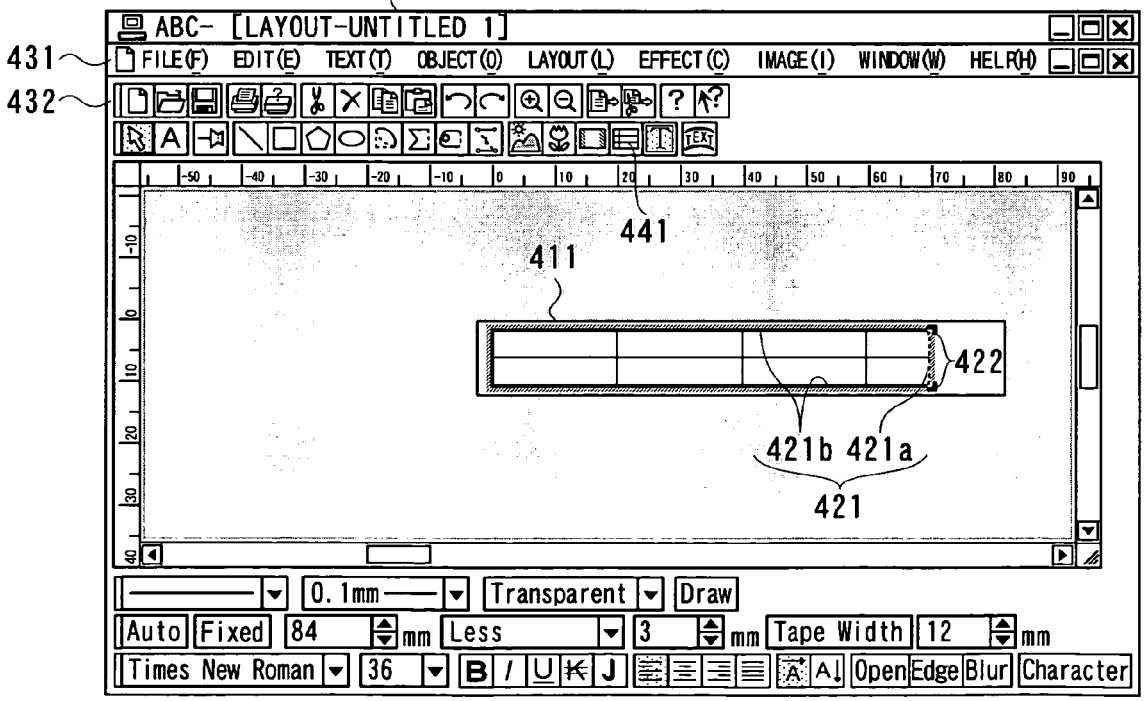

Then, as shown in FIGS. 11A and 11B, the reference table borders 421 are edited by changing the length and position of the reference vertical borders 421*a* and the reference horizontal borders 421*b* of the reference table borders 421. For example, when the reference vertical border 421*a* whose position is to be changed is double-clicked in the layout-editing screen 401, the reference table border 421 that defines the table outline is highlighted by shading, and handles 422 are indicated at both ends of this reference vertical border 421*a* so that the position of the reference vertical border 421*a* is changeable (see FIG. 11A). This reference vertical border 421*a* is dragged and moved to a desired position (see FIG. 11B). Thus, the reference table borders 421 can be edited so as to obtain the desired table borders shown in FIG. 8. As shown in FIGS. 12A and 12B, as any of the right and left reference vertical borders 421*a* and the top and bottom reference horizontal borders 421*b* that define the table outline, e.g., the rightmost reference vertical border 421*a*, is moved to the inside of the reference table borders 421 (in FIG. 12A, to the left), the length of the reference horizontal borders 421*b* or reference vertical borders 421*a* orthogonal to the moved reference vertical border 421*a* or reference horizontal border 421*b* (in FIG. 12A, the three reference horizontal borders 421*b*) is reduced accordingly.

When the reference table borders 421 are right-clicked and a "properties" menu is selected, a properties screen is brought up. A position tab in the properties screen is clicked to show a position-editing screen. The size and position (coordinates) of the overall reference table borders 421 may be set in the position-editing screen.

Thus, by changing the length and position of the reference vertical borders 421*a* and the reference horizontal borders 421*b* of the reference table borders 421, the reference table borders 421 can be edited so that each row and column defined by the reference table borders 421 has a desired row height and column width. The print table image data is therefore edited.

When a border tab in the properties screen is clicked, a similar border-editing screen to the table creating dialog box 450 is shown. In this border-editing screen, the number of rows or columns or the format of created reference table borders 421 may be changed in the manner similar to that in the table creating dialog box 450, thereby editing the reference table borders 421. For example, it is assumed that the number of rows defined the reference table borders 421 is set to "2", the number of columns is set to "4", and the format is set to "table format Fa". In this case, when the number of rows is changed to "4" in the border-editing screen, the reference table borders 421 are edited so that the reference horizontal borders 421*b* are re-created according to the "4" rows and are resized with an equal pitch (row height) therebetween. Then, the edited reference table borders 421 are shown in the border-editing screen.

As described above, the reference table borders 421 and the editing process of the reference table borders 421 are shown in the monitor display 340. Therefore, the user is able to easily edit the reference table borders 421 while viewing the monitor display 340.

In the foregoing embodiment, the personal computer PC prepares print image data (or the original text data thereof) by creating the print image data in the personal computer PC. The personal computer PC may load externally created print image data from the CD-ROM 501 or the like. In this case, various types of print image data may be obtained by replacing CD-ROMs 501, or may be modified according to the application.

The print table image creating software may be pre-installed (or pre-stored) in the personal computer PC. Alternatively, the print table image creating software may be stored in the CD-ROM 501 solely or in association with files including print table image data, and may be launched after, for example, downloading it. In this case, an application executable on a general-purpose operating system (OS) can be used merely by placing the CD-ROM 501 in a personal computer having the OS.

In this example, the CD-ROM 501 is used by way of example. Any other storage medium, such as an FD, a magneto-optical (MO) disk, or a digital versatile disk (DVD), may be used. With use of the network NW as in the first system configuration shown in FIG. 1, various data files or programs are receivable over the network NW or via a device (i.e., a supply device; in FIG. 1, the personal computer PC1 or the terminal adapter TA) directly connected with the tape printing device 1 from other devices (in FIG. 1, the workstations WS2 and WS3) connected to the network NW. It is therefore only required to receive various data files or programs from such devices in order to store (prepare) or modify new data files or programs. In this case, the program on the data server DS may include a tape-printing-device program, a portion of which can be used by downloading it to the tape printing device 1.

Figure 13:
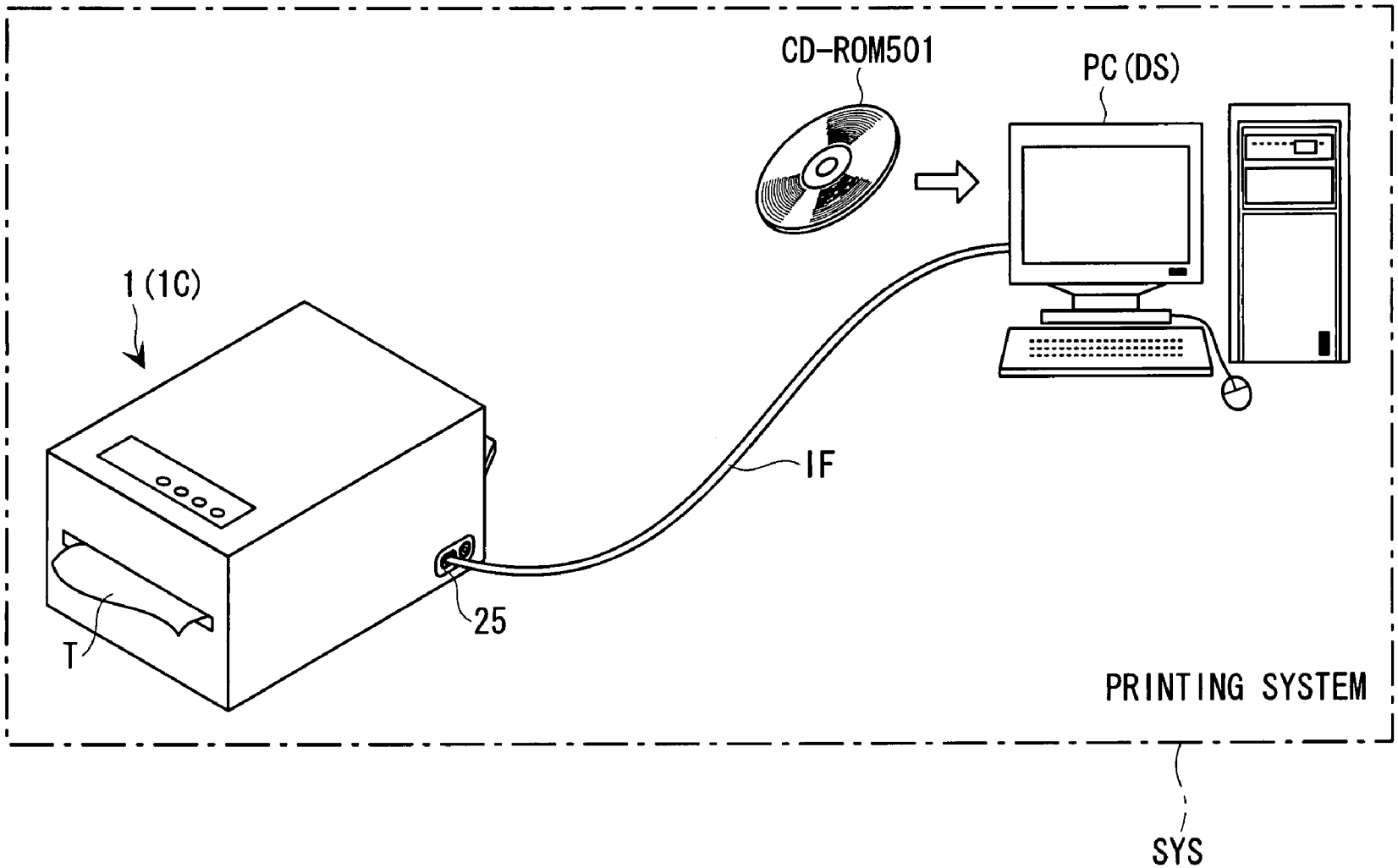
FIG. 13 is a diagram showing a third system configuration of a printing system according to an embodiment of this invention.
Figure 14:
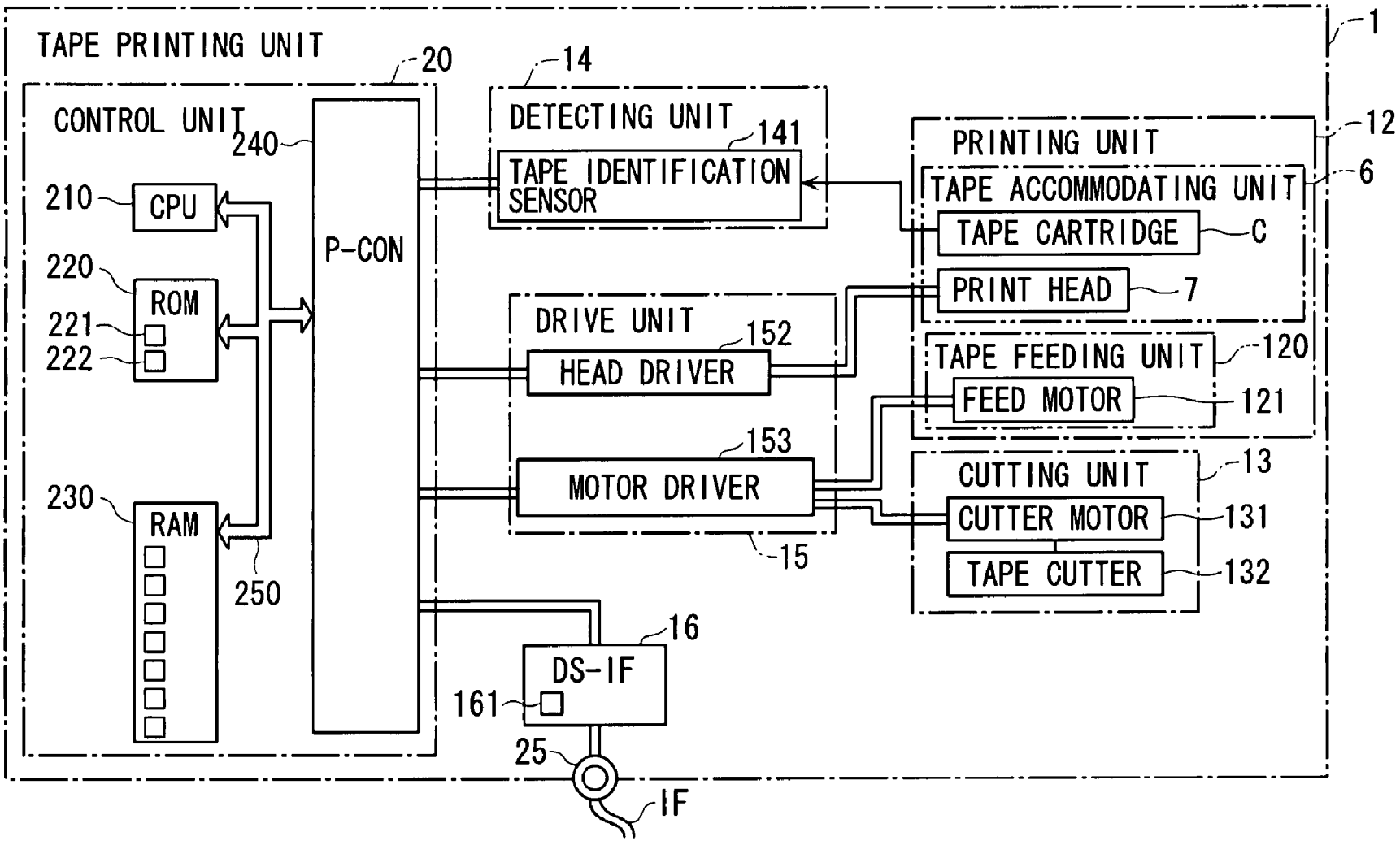
FIG. 14 is a schematic block diagram of the control system of a tape printing device in the third system configuration shown in FIG. 13.

In the foregoing embodiment, the tape printing device 1 includes the operating unit 11 having the keyboard 3 and the display 4. If the entirety of or most of the operation is performed according to instructions from the data server DS, the tape printing device 1 does not require the operating unit 11, and thus the function of the operating unit 11 may be removed. For example, a tape printing device 1C shown in FIGS. 13 and 14 without the operating unit 11 may be used.

The processing methods for the printing system SYS, including a label creating method, a data processing method, and so on, may be implemented by a program to be processed by various program-processible printing systems, and may be implemented by various storage media for storing this type of program. This program is stored in, read from a storage medium, or downloaded over a network, and is then executed, thereby easily creating table borders to form a print table image in a separate type of printing system.

According to the printing system, the method for processing data in the printing system, the program, and the storage medium of this invention, table borders can be easily created to form a print table image.

What is claimed is:

1. A printing system comprising:

a supply device that supplies print table image data of table borders having a plurality of horizontal borders and a plurality of vertical borders for defining table rows and columns; and a tape printing device that prints a print table image based on the supplied print table image data onto a tape, said supply device and said tape printing device being connected via an interface, wherein said tape printing device comprises tape-width notifying means for notifying said supply device of the tape width of a tape accommodated in said tape printing device, and said supply device comprises:

widthwise-size setting means for setting the size of the print table image in the tape-width direction based on the tape width;

table structure input means for inputting the number of rows and columns defined by the table borders;

reference-table-border creating means for creating reference table borders having a plurality of reference horizontal borders and a plurality of reference vertical borders based on the set size of the print table image in the tape-width direction and the input number of rows and columns; and print table image data editing means for editing the print table image data by changing and editing the length and position of the plurality of reference horizontal borders and the plurality of reference vertical borders of the reference table borders.

2. The printing system according to claim 1, wherein said supply device further comprises lengthwise-size input means for inputting the size of the print table image in the tape-length direction, and the reference-table-border creating means creates the reference table borders based on the input number of columns and the input size of the print table image in the tape-length direction.

3. A method for processing data in a printing system that comprises a supply device that supplies print table image data of table borders having a plurality of horizontal borders and a plurality of vertical borders for defining table rows and columns, and a tape printing device that prints a print table image based on the supplied print table image data onto a tape, wherein the supply device and the tape printing device are connected via an interface, the method comprising:

a tape-width notifying step of notifying the supply device of a tape width of a tape accommodated in the tape printing device;

a widthwise-size setting step of setting the size of the print table image in the tape-width direction based on the tape width;

a table structure inputting step of inputting the number of rows and columns defined by the table borders;

a reference-table-border creating step of creating reference table borders having a plurality of reference horizontal borders and a plurality of reference vertical borders based on the set size of the print table image in the tape-width direction and the input number of rows and columns; and a print table image data editing step of editing the print table image data by changing and editing the length and position of the plurality of reference horizontal borders and the plurality of reference vertical borders.

4. In a printing system comprising:

a supply device that supplies print table image data of table borders having a plurality of horizontal borders and a plurality of vertical borders for defining table rows and columns; and a tape printing device that prints a print table image based on the supplied print table image data onto a tape, said supply device and said tape printing device being connected via an interface, wherein said tape printing device comprises tape-width notifying means for notifying said supply device of the tape width of a tare accommodated in said tare printing device, and said supply device comprises:

widthwise-size setting means for setting the size of the print table image in the tape-width direction based on the tape width;

table structure input means for inputting the number of rows and columns defined by the table borders;

reference-table-border creating means for creating reference table borders having a plurality of reference horizontal borders and a plurality of reference vertical borders based on the set size of the print table image in the tape-width direction and the input number of rows and columns; and print table image data editing means for editing the print table image data by changing and editing the length and position of the plurality of reference horizontal borders and the plurality of reference vertical borders of the reference table borders;

a storage medium that stores a program so as to be readable by a program-processible printing system, the program causing each of the means of the printing system to function.

5. In a method for processing data in a printing system that comprises a supply device that supplies print table image data of table borders having a plurality of horizontal borders and a plurality of vertical borders for defining table rows and columns, and a tape printing device that prints a print table image based on the supplied print table image data onto a tape, wherein the supply device and the tape printing device are connected via an interface, the method comprising:

a tape-width notifying step of notifying the supply device of a tape width of a tape accommodated in the tare printing device;

a widthwise-size setting step of setting the size of the print table image in the tape-width direction based on the tape width;

a table structure inputting step of inputting the number of rows and columns defined by the table borders;

a reference-table-border creating step of creating reference table borders having a plurality of reference horizontal borders and a plurality of reference vertical borders based on the set size of the print table image in the tape-width direction and the input number of rows and columns; and a print table image data editing step of editing the print table image data by changing and editing the length and position of the plurality of reference horizontal borders and the plurality of reference vertical borders;

a storage medium that stores a program so as to be readable by a program-processible printing system, the program executing the steps of the method.

* * * * *